United States Patent [19]

Illguth

[11] Patent Number: 4,587,832

[45] Date of Patent: May 13, 1986

[54] PIPE BENDING TOOL

[76] Inventor: Frank J. Illguth, P.O. Box 10452, Fairbanks, Ak. 99710

[21] Appl. No.: 661,030

[22] Filed: Oct. 15, 1984

[51] Int. Cl.[4] ..... B21D 7/14

[52] U.S. Cl. ..... 72/459; 72/12; 72/32

[58] Field of Search ..... 72/10, 11, 12, 31, 35, 72/37, 458, 459, 21, 702, 317

[56] References Cited

U.S. PATENT DOCUMENTS

| | | | |
|---|---|---|---|
| 3,075,568 | 1/1963 | Bright | 72/11 |
| 3,440,847 | 4/1969 | Giordano | 72/12 |
| 3,718,018 | 2/1973 | Benfield | 72/31 |
| 3,763,510 | 10/1973 | Graham | 7/14.1 R |
| 3,965,714 | 6/1976 | Beard | 72/32 |
| 4,009,602 | 3/1977 | Linquist | 72/459 |
| 4,052,881 | 10/1977 | Mount | 72/459 |
| 4,063,444 | 12/1977 | Vecho, Jr. | 72/459 |
| 4,269,056 | 5/1981 | Kozinski | 72/459 |
| 4,321,820 | 3/1982 | Nason | 72/459 |
| 4,425,784 | 1/1984 | D'Gerolamo | 72/459 |
| 4,452,064 | 6/1984 | Custin | 72/459 |

FOREIGN PATENT DOCUMENTS

| | | | |
|---|---|---|---|
| 1076608 | 3/1960 | Fed. Rep. of Germany | 72/319 |
| 158214 | 12/1981 | Japan . | |

*Primary Examiner*—Francis S. Husar
*Assistant Examiner*—David B. Jones
*Attorney, Agent, or Firm*—Mallinckrodt & Mallinckrodt

[57] ABSTRACT

A tube bending tool for bending tubing, such as electrical metal tubing or plumbing tubing, signals the user by an indicator such as a audible signalling device when the tubing has been bent to a predetermined angle. The tool includes a bending anvil with a tube receiving area such as a tube receiving groove which receives the tube as it is bent, the greater the length of tube received by the groove the greater the degree of bend in the tube. A plurality of sensors such as switches are spaced along the tube receiving area so that as the tube is received by predetermined locations along the tube receiving area, a sensor changes state. A selector switch is coupled to an indicator and power source so that when a selected sensor changes state, indicating a predetermined degree of tube bend has been obtained, the indicator is activated.

19 Claims, 4 Drawing Figures

PIPE BENDING TOOL

BACKGROUND OF THE INVENTION

1. Field

This invention is in the field of bending tools for tubing such as electrical metal tubing or plumbing tubing.

2. State of the Art

The installation of tubing such as electrical metal tubing encasing electrical wiring or copper plumbing tubing often requires that the tubing be bent to accommodate and circumvent physical barriers. Such bending is accomplished at the construction or installation site, and so requires a portable tube bending tool which will accurately bend such tubing into the desired arc. There are numerous styles and designs of tube bending tools, some of which require the operator's visual inspection of indicia on the bending tool in order to achieve an accurate bend, and others which have a stopping device which prevents the tubing from being bent beyond a pre-set angle. Each of these types of bending tools are limited in their usefulness.

Tools which require visual inspection of indicia on the tool are illustrated in Mount, U.S. Pat. No. 4,052,881; Kozinski, U.S. Pat. No. 4,269,056; Benfield, U.S. Pat. No. 3,718,018; Linquist, U.S. Pat. No. 4,009,602; and Vecho, Jr., U.S. Pat. No. 4,063,444 which show indicia on the tool itself which must be aligned with the bent tubing to measure the degree of bend accomplished, and D'Gerolamo, U.S. Pat. No. 4,425,784 which shows an air bubble gauge, similar to the one in a carpenter's level, mounted on the handle of the tool, which measures the angle of the bend. These tools are limited in their usefulness by the required visual inspection of either the indicia on the tool relative to the bend or the air bubble relative to the lines of the bubble gauge. Necessarily, use of tools requiring visual inspection is limited to well-lit installation or contruction sites. Furthermore, even in well-lit sites, it may be time consuming to visually inspect, and perhaps reinspect, the bending tool's indicia to determine the accuracy of the bend. Additionally, since operators may differ in their perception of when the tool's indicator lines are even with respect to the bent tubing, there may be a large degree of variation between one operator's work and another's.

Tools which rely on a stopping device that physically prevents bending beyond a predetermined point generally use a stopping device that is located on the bending anvil of the tool. A small error in adjusting the position of the device results in a magnified error in tube bending accuracy. This requires that the operator make extremely careful adjustments in order that an accurate bend be achieved due to the location of the stopping device itself. Because the adjustments must be carefully made, they are expensive with respect to operator's time. A stopping device for a tube bending tool is shown in Nason, U.S. Pat. No. 4,321,820. It features an adjustable gauge arm which extends from the handle of the bending tool, and which prevents bending beyond a predetermined arc. Such a tool requires that the portion of the tubing being bent be coplanar with the gauge arm. Depending on the shape of the obstruction around which the tubing must eventually fit, it may be necessary to bend the tubing into a variety of planes, and such a tool would not always provide an accurate means of arc measurements in these circumstances.

Innacurately bent tubing results in the loss of an operator's time and materials, losses which the operator seeks to minimize. Therefore, it is clear that there is a need for a tube bending tool which will provide accurate and consistent bending both in areas where visual inspection is limited and in situations where physical stopping devices are impractical.

SUMMARY OF THE INVENTION

According to the invention, a tube bending tool is provided with an indicator means such as a buzzer or light which can be set to be activated when the tube being bent has been bent to a predetermined angle. The use of an indicator means such as a buzzer or light which is either "on" or "off" provides a positive and accurate indication to the user of the tool that a bend of a certain degree has been obtained.

The tool includes a handle and a bending anvil secured to one end of the handle and having a tube securing means such as the normal hook at one end thereof and tube receiving area such as is generally defined as a tube receiving groove extending from the hook along the anvil so that as a tube is bent, it contacts at least a portion of the tube receiving area. The portion of the tube receiving area contacted is greater the greater the angle of tube bend and is a measure of the degree of bend formed in the tube. A plurality of sensing means, such as electrical microswitches, are spaced along the tube receiving area so that as a predetermined portion of the tube receiving area is contacted by the tube during bending, representing the degree of bending of the tube, successive sensing means change state. An indicator is provided such as a light or buzzer and a selector means such as a multiposition switch is also provided so that the user of the tool can select which sensor means will cause operation of the indicator. Sensors will usually be located so the user can select standard bends such as 22.5°, 30°, 45°, 60°, and 90°.

THE DRAWINGS

In the accompanying drawings, which illustrate an embodiment of the invention constituting the best mode presently contemplated for carrying out the invention in actual practice:

FIG. 1 is a side elevation of a tool of the invention showing a portion of the handle broken away for ease of illustration and a portion of the anvil broken away to show some of the sensors;

FIG. 2, a fragmentary vertical section taken on the line 2—2 of FIG. 1, drawn to a larger scale;

FIG. 3, a fragmentary vertical section taken on the line 3—3 of FIG. 1, and drawn to a large scale; and FIG. 4, a circuit diagram showing a preferred form of electrical circuitry for use in the tool of the invention.

DETAILED DESCRIPTION OF THE ILLUSTRATED EMBODIMENT

Figure 3:
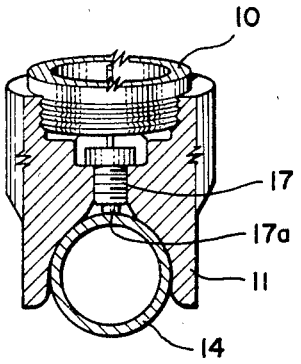
Figure 2:
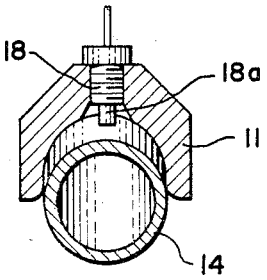
Figure 1:
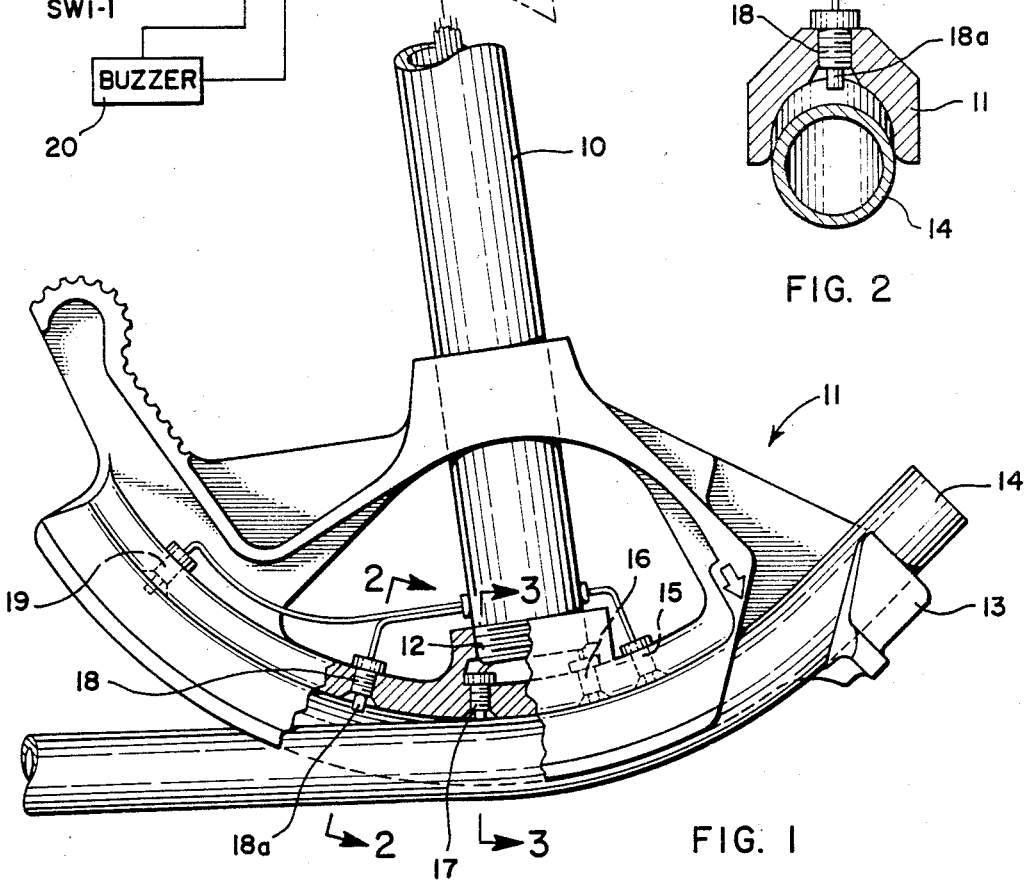

Referring to FIG. 1 of the drawings, the tube bending tool has a handle 10, shown, for ease of illustration, with the center portion broken away, and a bending anvil 11 secured as by threads 12 to one end of the handle 10. The anvil is curved, as shown, with a hook 13 forming a tube securing means to hold a tube 14 at the end of the anvil during bending of the tube. The curved side of the anvil is generally U shaped as shown in FIGS. 2 and 3 so as to form a tube receiving area in the U extending from the hook 13 along the curved side of the anvil.

To bend the tube, the tube 14 is inserted in hook 13 and the tool is rotated so as to force the tube into and progressively along the groove or tube receiving area. As the tube is forced against the tube receivng area, it is bent to the same radius as the radius of the curve of the anvil. The handle 10 is usually relatively long so as to provide leverage during the bending operation.

The degree of the arc of the bend is determined by the length of the tube receivng area of the anvil along which it is bent; the longer the arc, the greater the degree of the bend. Consequently, if the tube is bent along only a short length of the anvil's arc, the degree of bend will be smaller than if the tube is bent along the full length of the anvil's arc. Generally, the anvil will be configured so that if the tube is bent along substantially its entire tube receiving area, it will be bent 90°. If bent through substantially half the tube receiving area, as shown in FIG. 1, it will be bent through 45°. Thus, the greater the tube receiving area of the anvil contacted by the tube, the greater the degree of bend of the tube, the area contacted being proportional to and a measure of the degree of bend.

In order to signal the degree of bend, a plurality of sensors are located in the tube receiving area of the anvil to sense the portion of the area contacted by the tube. In the illustrated embodiment, the sensors take the form of push button switches such as microswitches 15 through 19 placed at predetermined distances along the curved anvil's bending groove from the anvil's hook-bearing end. The position of each microswitch, or the length of the arc along the curved anvil from its hook-bearing end to the microswitch, corresponds to a specific angle to which a piece of tubing may be bent.

The actuating button of each microswitch projects beyond the bottom of the anvil's groove, and will be depressed by the tube when the tube has been sufficiently bent to contact the bottom of the groove at the position of the switch. When a length of tubing is initially inserted into the anvil's hook, it is straight and does not depress any of the microswitch buttons. As the tube is bent along the full arc or length of the tube receiving area of the anvil, the tube successively depresses the buttons of the microswitches beginning with the switch nearest the hook, and ending with the switch farthest from the hook. Thus, as shown in FIG. 1, the button of switches 15, 16, and 17 have been depressed while the buttons of switches 18 and 19 have not yet been depressed. FIG. 2 shows switch 18 with button 18*a* extending therefrom into the groove. The tube has not yet contacted the bottom of the groove at the location of switch 18 so has not depressed the button. FIG. 3 shown switch 17 with button 17*a* depressed. The tube 14 has contacted the bottom of the groove at the position of switch 17 and thus depressed the button.

Figure 4:
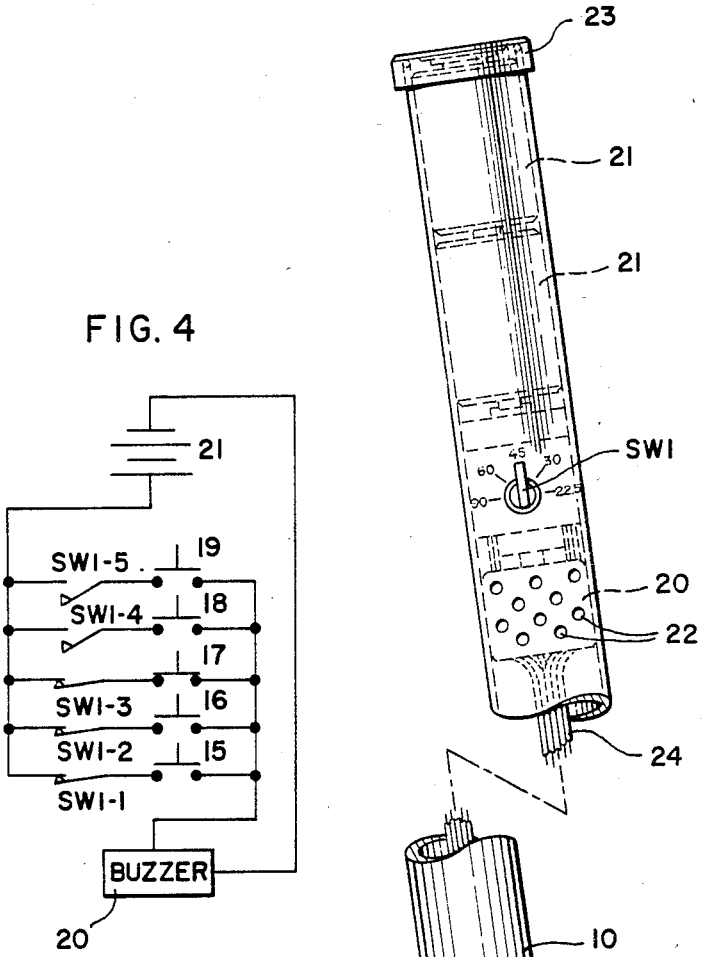

FIG. 4 is a circuit diagram of a circuit satisfactory for use in the invention. The microswitches 15 through 19 are numbered as such in FIG. 4. In this particular embodiment, the switches are normally open and are closed when the buttons are depressed. Each microswitch is connected electrically in series with one pole of a multiple selector switch SW1, shown in FIG. 1 as a five pole rotary selector switch. The number of poles required on the selector switch depends upon the number of microswitches used, a pole of the selector switch being required for each microswitch. As shown in FIG. 4, pole SW1-1 is connected in series with switch 15, SW1-2 with switch 16, SW1-3 with switch 17, SW1-4 with switch 18, and SW1-5 with switch 19. The series switch connections are connected in electrical parallel with an indicator means shown as buzzer 20 and a source of power such as batteries 21. The selector switch is used to selected which microswitch will activate the indicator. Thus, in FIG. 1, selector switch SW1 is set to the position for 45° which corresponds to pole SW1-3 in FIG. 4. In this position, as a tube is bent, it will first depress microswitch 15 which is positioned along the bending groove so that it is depressed and electrically closed when the tube is bent to 22.5°. Since pole SW1-1 of the selector switch is open, the buzzer is not activated upon closure of microswitch 15. Bending of the tubing continues and microswitch 16, which is positioned along the bending groove to be closed when the tubing is bent through 30°, is closed. Again, since pole SW1-2 of the selector switch is open, the closure of switch 16 does not activate the buzzer. Bending continues and microswitch 17, positioned along the bending groove to be closed when the tubing is bent through 45°, is closed. Here, since selector switch SW1 is set for 45° and pole SW1-3 is closed, upon closure of switch 17, a circuit is completed and current flows from the batteries 21, through buzzer 20, switches 17 and SW1-3 back to the batteries. The buzzer is thus activated and the user is given an easily identifiable indication that he has bent the tubing to the desired 45°. In similar manner, the buzzer can be set to operate upon closing of any of the microswitches.

Rather than a buzzer, any indicating means which is either "on" or "off" can be used so that an easily identifiable indication is given to the user. Thus, rather than a buzzer, a light could be used. As shown in FIG. 1, when a buzzer is used and mounted in the tool handle, perforations 22 may be provided through the handle to allow better sound transmission from the buzzer to the air about the tool. Also, a cap 23 may be threaded onto or otherwise removably secured to the end of the handle so that batteries 21 may be easily replaced. Wires 24 will extend between the individual switches 15–19 on the bending anvil and the remainder of the circuitry located in the tool handle.

While particular circuitry has been shown, it should be realized that various circuits could be used to operate an indicator means and various sensors rather than the microswitches shown could be used to sense the position of the tube along the tube receiving area during bending. Also, while five microswitches are shown corresponding to bends of 22.5°, 30°, 45°, 60°, and 90°, additional switches could be added for additional angles. In addition, the selector means could be a series of separate switches rather than the rotary switch shown, or be could various other types of selector switches.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A hand operated tube bending tool, comprising a handle; a bending anvil secured to one end of the handle and having a tube securing means at one end thereof and a tube receiving area extending therealong from the tube securing means so that as a tube is bent it contacts at least a portion of the tube receiving area, the portion contacted being greater the greater the angle of the bend being formed in the tube and the portion contacted being a measure of the degree of bend formed in the tube; a plurality of electrical sensing means spaced along the tube receiving area so that as predetermined portions of the tube receiving area are contacted, successive sensing means change electrical state; electrically operated indicator means; selector means for selecting which sensing means will cause activation of the indicator means upon that sensing means changing state; and means for supplying power to the indicator means when the indicator means is activated.

2. A tube bending tool according to claim 1, wherein the sensing means are switches.

3. A tube bending tool according to claim 2, wherein the switches are of the push button type and wherein the actuating buttons extend into the tube receiving area so that as the tube contacts the tube receiving area at the location of a switch, the tube depresses the actuating button of the switch.

4. A tube bending tool according to claim 3, wherein the tube receiving area is a tube receiving U-shaped groove and the switch actuating buttons extend from the bottom of the groove.

5. A tube bending tool according to claim 1, wherein the tube receiving area is a tube receiving U-shaped groove and the sensing means are located along the bottom of the groove.

6. A tube bending tool according to claim 5, wherein the sensing means are located along the tube receiving groove such that a sensing means is actuated to change state as a tube is bent through 22.5°, 30°, 45°, 60°, and 90°.

7. A tube bending tool according to claim 1, wherein the indicator means is a buzzer connected so as to be activated when a selected sensing means changes state.

8. A tube bending tool according to claim 1, wherein the power source is at least one battery and the at least one battery, indicating means, and selector means are located in the handle of the tool.

9. A tube bending tool according to claim 1, wherein the indicating means produces an audible signal when activated.

10. A tube bending tool, comprising a handle; a bending anvil secured to one end of the handle and having a tube securing means at one end thereof and a tube receiving area extending therealong from the tube securing means so that as a tube is bent it contacts at least a portion of the tube receiving area, the portion contacted being greater the greater the angle of the bend being formed in the tube and the portion contacted being a measure of the degree of bend formed in the tube; a plurality of sensing means spaced along the tube receiving area so that as predetermined portions of the tube receiving area are contacted, successive sensing means change state; indicator means; means for supplying power to the indicator means when the indicator means is activated; and a multipole selector switch for selecting which sensing means will cause activation of the indicator means, the number of poles of said switch being at least equal to the number of sensing means located along the tube receiving area, a separate pole of the selector switch being connected electrically in series with respective sensing means, each series connection of a pole of the selector switch and a sensing means being connected in parallel and the parallel combination being connected in series between the power source and the indicator means such that when a pole of the selector switch and its associated sensing means are both electrically closed, the circuit between the power source and indicator means is completed and the indicator means activated.

11. A tube bending tool according to claim 10, wherein the sensing means are switches.

12. A tube bending tool according to claim 11, wherein the switches are of the push button type and wherein the actuating buttons extend into the tube receiving area so that as the tube contacts the tube receiving area at the location of a switch, the tube depresses the actuating button of the switch.

13. A tube bending tool according to claim 12, wherein the tube receiving area is a tube receiving U-shaped groove and the switch actuating buttons extend from the bottom of the groove.

14. A tube bending tool according to claim 13, wherein the push button switches are located along the tube receiving groove such that a successive switch is actuated as a tube is bent through 22.5°, 30°, 45°, 60°, and 90°.

15. A tube bending tool according to claim 10, wherein the indicator means produces an audible signal when activated.

16. A tube bending tool according to claim 15, wherein the indicator means is a buzzer.

17. A tube bending tool according to claim 16, wherein the power source is at least one battery and the at least one battery, buzzer, and selector switch are located in the handle of the tool.

18. A tube bending tool according to claim 10, wherein the sensing means are located along the tube receiving area such that a sensing means is actuated to change state as a tube is bent through 22.5°, 30°, 45°, 60° and 90°.

19. A tube bending tool according to claim 10, wherein the power source is at least one battery and the at least one battery, indicator means, and selector means are located in the handle of the tool.

* * * * *